US006776549B2

(12) United States Patent
Gueret

(10) Patent No.: US 6,776,549 B2
(45) Date of Patent: Aug. 17, 2004

(54) DEVICE AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/230,266

(22) Filed: Aug. 29, 2002

(65) Prior Publication Data

US 2003/0063945 A1 Apr. 3, 2003

(30) Foreign Application Priority Data

Aug. 29, 2001 (FR) ..... 01 11217

(51) Int. Cl.[7] ..... B43K 5/04; A45D 33/00
(52) U.S. Cl. ..... 401/170; 401/126; 401/130
(58) Field of Search ..... 401/170, 171, 401/176, 183, 189, 186, 152, 153, 156, 123, 124, 125, 126, 130; 132/317

(56) References Cited

U.S. PATENT DOCUMENTS

| | | | | |
|---|---|---|---|---|
| 876,090 A | * | 1/1908 | Prescott | 401/170 |
| 1,021,709 A | | 3/1912 | Snow | |
| 1,056,457 A | | 3/1913 | Schloss | |
| 1,063,484 A | | 6/1913 | Weismantel | |
| 1,172,293 A | | 2/1916 | Kohlhepp | |
| 1,450,386 A | | 4/1923 | Regan | |
| 1,497,442 A | * | 6/1924 | Hess | 401/129 |
| 2,069,048 A | | 1/1937 | Rehberger | |
| 2,554,489 A | | 5/1951 | Crane | |
| 2,691,184 A | | 10/1954 | Miller et al. | |
| 3,456,650 A | | 7/1969 | Schwartzman | |
| 3,456,851 A | | 7/1969 | Mattes et al. | |
| 3,592,365 A | | 7/1971 | Schwartzman | |
| 3,682,558 A | | 8/1972 | Miller | |

(List continued on next page.)

FOREIGN PATENT DOCUMENTS

| | | |
|---|---|---|
| DE | 938 658 | 1/1956 |
| DE | 406 544 | 8/1966 |
| EP | 0 163 189 | 12/1985 |
| EP | 0 416 185 | 3/1991 |
| EP | 0 612 488 | 8/1994 |

(List continued on next page.)

OTHER PUBLICATIONS

Co–pending Application No. 09/666,450; Title: Packaging and Application Device Inventors(s): Jean–Louis H. Gueret U.S. Filing Date: Sep. 21, 2000 Preliminary Amendment Filed: Sep. 21, 2000 Supplemental Preliminary Amendment Filed: Oct. 31, 2000 Supplemental Preliminary Amendment/ Response to Restriction Requirment Filed: Oct. 24, 2001 Amendment Filed: May 3, 2002.

(List continued on next page.)

*Primary Examiner*—David J. Walczak
(74) *Attorney, Agent, or Firm*—Finnegan, Henderson, Farabow, Garrett & Dunner, LLP

(57) ABSTRACT

A device for applying a product defines a height and includes a first compartment defining a reservoir for containing a product. The first compartment may include a variable volume. The device may include a second compartment defining an opening and being in one of selective and permanent flow communication with the first compartment via at least one orifice. The second compartment may be configured to at least partially receive an applicator for applying the product, and may define a volume which is substantially fixed. The device may include a closure element configured to close off the opening of the second compartment. The device may be configured so that the height of the device diminishes as the volume of the first compartment becomes reduced, and at a last use of the device, the axial height of the device may be less than the axial height of the device at a first use of device.

163 Claims, 8 Drawing Sheets

U.S. PATENT DOCUMENTS

| | | | |
|---|---|---|---|
| 4,693,623 | A | 9/1987 | Schwartzman |
| 4,780,017 | A | 10/1988 | Bradford |
| 4,832,060 | A | 5/1989 | Kingsford |
| 4,925,327 | A | 5/1990 | Wirt |
| 4,929,108 | A | 5/1990 | Gueret |
| 4,974,981 | A | 12/1990 | Bennett |
| 5,492,426 | A | 2/1996 | Gueret |
| 5,636,931 | A | 6/1997 | Gueret |
| 5,945,076 | A | 8/1999 | Leonard et al. |
| 6,082,918 | A | 7/2000 | Gueret |
| 6,305,863 | B1 | 10/2001 | Gueret |
| 6,309,124 | B1 | 10/2001 | Gueret |

FOREIGN PATENT DOCUMENTS

| | | |
|---|---|---|
| EP | 0 688 516 | 12/1995 |
| EP | 0 855 177 | 7/1998 |
| EP | 0 931 476 | 7/1999 |
| EP | 1 020 135 | 7/2000 |
| FR | 2 789 660 | 8/2000 |
| FR | 2 798 646 | 3/2001 |
| GB | 1 158 412 | 7/1969 |
| JP | U 64-39879 | 3/1989 |
| JP | U 2-98306 | 4/1990 |
| JP | U 03-57089 | 5/1991 |
| JP | U 6-3473 | 1/1994 |
| JP | U 6-296520 | 10/1994 |
| JP | U 7-313247 | 12/1995 |

OTHER PUBLICATIONS

English language translation of DE 406 544.

English language Derwent Abstract of DE 2 132 433, Jan. 11, 1973.

English language Derwent Abstract of FR 2 798 646, Mar. 23, 2001.

English language translation of DE 2 132 433.

* cited by examiner

DEVICE AND METHOD FOR APPLYING A PRODUCT

The present invention relates to a device for applying a product, for example, one or more cosmetic products. For example, the device may be used to apply cosmetic products such as those defined in Counsel Directive 93/35/EEC (European Economic Community) dated Jun. 14, 1993, which provides merely one example of a definition of cosmetic products and should not be considered as limiting. The device may be suitable, for example, for applying products in the form of a liquid, a gel, and/or a cream. Cosmetic products may include care products and/or other products for the skin and/or the hair, for example, make-up products, make-up removers, or hair-dye products.

In the field of cosmetic products, for example, products in the form of a milk, a cream, and/or a gel, may be dispensed under pressure via a pump. Some products may be unstable when exposed to air and may be packaged in pump systems that do not provide air intake (e.g., packaged under a vacuum in packaging having a volume that diminishes as a result of use). Some examples of devices for dispensing such products include a pouch having retractable walls, a tube having deformable walls, and a bottle in which a follower piston may be arranged. The pump of such devices may include a piston-type pump, a membrane-type pump, or a shutter-type pump.

In order to apply some cosmetic products, a user may place product expelled via a pump on one or more of his or her fingers and apply it, for example, by massaging the surface to be treated with the product. In some cases, the product may be applied via an applicator.

In instances where an applicator is reused a number of times, for example, throughout the life of the product, it may be desirable for the applicator to be stored between uses so that it may be protected from the air to prevent its mechanical properties (e.g., flexibility and/or absorption) from being adversely affected. In the case of an applicator that is not cleaned after each use, contact between the product remaining on the applicator and the ambient air (or other elements of the environment in which it may be stored) may risk soiling the applicator and adversely affecting the product it carries. Thus, transportation of an applicator of this type, for example, in a user's handbag or other carry-all, may present problems.

In the case of certain devices, for example, devices having applicators configured to be tailored to the profile of the surface to be treated (e.g., the lips or the corners of the eyes), it may be desirable for the product to be consistently deposited on the applicator in substantially the same fashion and/or in substantially the same quantity so that the product can applied in a consistent manner from one application to the next.

Examples of some devices for applying products are generally described in the following patent applications: EP-A-0 416 185 and EP-A-0 931 476; and in U.S. Pat. No. 5,636,931. These devices generally include first and second housings in communication with each other and a removable applicator element for applying the product. In some examples, one of the two housings is intended for receiving an applicator having an integral gripper, for example, in the form of a stopper which may be capable of closing off an opening of the housing intended to receive the applicator. For example, by rotating the stopper relative to a body of the device, the product may become pressurized and may be forced into the applicator's housing. In some examples of devices, a barrier may be provided which separates the two housings and which moves axially and/or rotationally inside the body of the device. The axial height of these devices does not vary during the movement of the wall, and the overall size of the devices remains constant throughout their use.

One subject of the invention relates to providing a device that fully or partly obviates one or more of the drawbacks associated with the related art. Another subject of the invention relates to providing a device which may be well-suited for applying products having a relatively high viscosity such as, for example, products in the form of gels, creams, and/or pastes. A further subject of the invention relates to providing a device that may be capable of precise and reproducible loading of an applicator with product. Another subject of the invention relates to providing a device that may be relatively simple to use and produce in an economical manner.

In the following description, certain aspects and embodiments will become evident. It should be understood that the invention, in its broadest sense, could be practiced without having one or more features of these aspects and embodiments. It should be understood that these embodiments are merely exemplary.

In one aspect, as embodied and broadly described herein, the invention includes a device for applying a product. The device defines a height and may include a first compartment defining a reservoir for containing a product. The first compartment may have a variable volume. The device may include a second compartment defining an opening and being in one of selective and permanent flow communication with the first compartment via at least one orifice. The second compartment may be configured to at least partially receive an applicator for applying the product, and may define a volume which is substantially fixed. The device may include a closure element configured to close off the opening of the second compartment. The device may be configured so that the height of the device diminishes as the volume of the first compartment becomes reduced. The device also may be configured so that at a last use of the device, the axial height of the device may be less than the axial height of the device at a first use of device (e.g., the device may lack a bellows structure (or piston structure) that returns to its original expanded state resiliently (i.e., with resilience) after being placed in a reduced volume state).

According to another aspect, the closure element may be configured to seal the opening of the second compartment in a substantially product-tight manner. In another aspect, the closure element may be configured to seal the opening of the second compartment in a substantially air-tight manner. Thus, between two applications, the applicator may be sealed inside the second housing and may be protected from the air which may allow the applicator to retain good mechanical properties and may prevent any product remaining on the applicator from being adversely affected in the presence of air and/or fouling the applicator.

The reduction in volume of the first compartment containing the product may result in an overpressure condition inside the first compartment, which may force the product to exit from the first compartment via the orifice, thereby entering the second compartment containing the applicator regardless of the viscosity of the product.

Moreover, as the axial height of the device diminishes with the volume of the first compartment, the overall size of the assembly may be reduced. This may, for example, render it possible for the user to identify the amount of product remaining in the device.

In still another aspect, the device may include a piston configured to slide axially in the first compartment in response to a force exerted on the second compartment. For example, the piston may be configured to slide inside the first compartment in response to a force exerted on the closure element. Thus, the user may receive the impression of pressing on a push-button of a conventional pump device.

According to yet another aspect, the first compartment may include an outer wall, the second compartment may include a lateral wall, and the device may include an actuator having a screw thread. The actuator may be integral with the lateral wall of the second compartment, and the screw thread may be configured to interact with the outer wall of the first compartment, for example, so as to cause the piston to slide inside the first compartment in response to threading the actuator onto the first compartment.

In still a further aspect, the second compartment may include a lateral wall, and the piston and lateral wall of the second compartment may be formed as a single piece. For example, the piston may be integral with the lateral wall of the second compartment, and the they may be connected to one another via at least one of adhesive bonding and clasping. In another example, the lateral wall and/or the base of the second compartment may simply bear either alone or together on the piston. In another aspect, the piston may include an axial set-back substantially surrounded by an extension of the lateral wall of the second compartment. In another arrangement, the lateral wall and/or the base of the second compartment may simply bear alone or together on the piston.

The piston and the second compartment may each define a cross-section, wherein the cross-section of the piston is substantially identical to the cross-section of the second compartment. Thus, in some embodiments where the force exerted on the second compartment that moves the piston toward the first compartment, that force may be relatively low. For example, when the actuator is actuated (e.g., when pressure is applied to the closure element), the force exerted on the second compartment may be distributed over its entire periphery. This force may be transmitted to the piston in a substantially equal manner over its entire periphery because its cross-section is substantially the same as that of the second compartment.

According to yet another aspect, the first compartment may include an inner wall and the piston may form a sealing lip configured to slide along the inner wall of the first compartment.

In still another aspect, the device may include means for keeping the first and second compartments linked together. This may, for example, prevent any risk of untimely opening of the reservoir containing the product.

In another aspect, the device may include a one-way valve configured to close the orifice. For example, the one-way valve may be configured to open to permit product flow toward the second compartment in response to an overpressure generated in the first compartment. The one-way valve may render it possible to improve metering the amount of product exiting the reservoir. Some examples of one-way valves include a flap valve and a ball valve.

In a further aspect, the device may include an applicator configured to be received at least partially in the second compartment. In some exemplary embodiments, the applicator may be fixedly attached to the closure element. For example, the applicator may be fixedly attached to the closure element via at least one of adhesive bonding, welding, and pinching (e.g., crimping). In other examples, it may be screwed or snap-fitted onto the device in a reversible manner.

In an additional aspect, the closure element may be configured to provide a gripping surface for the applicator.

In another aspect, the second compartment may include a wall and the applicator that may be fixedly attached to the wall of the second compartment. For example, the applicator may be fixedly attached to the wall of the second compartment via at least one of adhesive bonding, welding, and pinching.

In still a further aspect, the applicator may be at least one of configured to be loaded with cosmetic product at its surface and configured to be loaded with cosmetic product through its depth. For example, at least a portion of the applicator may include a porous material, for example, a material selected from sintered materials, thermoplastic materials, ceramic materials, felts, elastically compressible materials, foams having closed cells, foams having open cells, foams having semi-open cells, and elastomers. In another aspect, the applicator may include a semi-rigid plastics material (e.g., a material that includes micro-roughnesses). In still another aspect, the applicator may include a superposition of layers of material.

With materials of this type, the release of product onto the surface to be treated may take place either by capillary effect or by the effect of surface tension in contact with the skin or by expulsion of the product from the pores of the applicator in response to a slight deformation (e.g., by means of pressure) of the applicator on the surface to be treated. The applicator may comprise several different materials, for example, a stack of foams having different hardnesses. It may be possible for some of the foams to have open cells and the remainder to have closed cells. For example, the applicator may include a material selected from polyethers, polyesters, polyurethanes, NBRs (arylonitrile-butadiene rubber), SBRs (styrene butadiene rubber) and/or PVC (polyvinyl chloride) foams, and/or polyethylenes, bronzes, glasses, silicones, and/or nylon frits. For example, an applicator may be formed from elastically compressible materials. When the applicator is elastically compressible, the application surface located, for example, opposite the orifices via which the product is supplied, may be able to yield elastically under the pressure of the product so as to allow greater loading at its surface and/or through its depth.

According to another aspect, at least a portion of a surface of the applicator may be covered with a flocking. The flocking, for example, may include least one of rayon fibers, cotton fibers, viscose fibers, nylon fibers, a woven covering, and a non-woven covering. The flocking may help to create a reserve of product immediately in the vicinity of the application surface. Moreover, it may confer greater softness upon application, for example, when the applicator is formed from wide-cell foams. The flocking may include a mixture of fibers having for example, different lengths, and/or type, and/or diameter. In another aspect, at least a portion of the surface of the applicator may be covered with a woven and/or non-woven covering.

In an additional aspect, the second compartment may define an inner wall, and the applicator (e.g., the applicator fixed to the closure element) may contact at least a portion of the inner wall of the second compartment. For example, the inner wall may define a base of the second compartment and the applicator may contact the base of the second compartment. The inner wall of the second compartment (e.g., the compartment intended for receiving the applicator) may have a shape that substantially complements the shape of the applicator so that, for example, the applicator may contact the inner wall (e.g., in intimate and/or elastic fashion) and be substantially loaded with product. The applicator may, for example, have a convex and/or concave profile, and may have a circular, triangular, or square cross-section, although other cross-sectional shapes are contemplated.

In some exemplary embodiments having an applicator formed from, for example, elastically compressible materials (e.g., foams), the applicator may be dimensioned relative to the second housing in such a manner that, in an assembled position inside the second housing, the applicator may not be substantially compressed in an axial direction. This may enhance the above-mentioned yielding possibly due to the low resistance offered by the applicator.

In another aspect, it may be possible to provide an applicator which may be partially compressed axially inside its housing so that, for example, upon removal of the closure element, product located in the vicinity of the surface of the applicator may be pumped through its depth inside the applicator in response to decompression of the foam. Some embodiments of this type may be more suited to compositions having a low viscosity.

In another aspect, the device may include a product (e.g., a cosmetic product) contained in the first compartment. For example, the product may include at least one of a liquid, a milk, a cream, and/or a gel.

In still a further aspect, the device may define a height and include a first compartment defining a reservoir configured to contain a product, wherein the first compartment has a variable volume. The device may include a second compartment defining an opening and being in one of selective and permanent flow communication with the first compartment via at least one orifice. The second compartment may be configured to at least partially receive an applicator, and may define a volume which is substantially fixed. The device may include a closure element configured to close off the opening of the second compartment. The device may be configured so that the height of the device diminishes as the volume of the first compartment becomes reduced. The device may be configured so that the first compartment does not resiliently expand to increase its volume after the volume of the first compartment becomes reduced (e.g., the first compartment may be configured so that it lacks a bellows (or piston) that is moved through resilience to return the first compartment to its expanded volume after being placed in its reduced volume state).

According to yet another aspect, the device defines a height and may include a first compartment defining a reservoir for containing a product, wherein the first compartment has a variable volume. The device may include a second compartment defining an opening and being in one of selective and permanent flow communication with the first compartment via at least one orifice. The second compartment may be configured to at least partially receive an applicator and define a volume which is substantially fixed. The device may include a closure element configured to close off the opening of the second compartment, and a piston configured to slide in the first compartment. The device may be configured so that the height of the device diminishes as the volume of the first compartment becomes reduced, and the device may lack a structure biasing the piston (e.g., lack a spring biasing the piston).

In another aspect, the device defines a height and may include an applicator for applying a product, a first compartment defining a reservoir configured to contain a product, wherein the first compartment has a variable volume, and a second compartment defining an opening. The second compartment may be configured to at least partially receive the applicator for applying the product, and may define a volume which is substantially fixed. The device may include a piston configured to slide in the first compartment, a one-way valve configured to permit flow of product from the first compartment to the second compartment, and a closure element configured to close off the opening of the second compartment. The device may be configured so that the height of the device diminishes as the volume of the first compartment becomes reduced.

According to yet an additional aspect, the device defines a height and may include a first compartment defining a reservoir for containing a product, wherein the first compartment may have a variable volume, and a second compartment may define an opening and may be in one of selective and permanent flow communication with the first compartment via at least one orifice. The second compartment may be configured to at least partially receive an applicator and define a volume which is substantially fixed. The device may include a closure element configured to close off the opening of the second compartment. The device may be configured so that the height of the device diminishes as the volume of the first compartment becomes reduced. At least a portion of the second compartment may be configured to slide within the first compartment.

In still another aspect, the device defines a height and may include a first compartment defining a reservoir for containing a product, wherein the first compartment has a variable volume, and a second compartment defining an opening and being in one of selective and permanent flow communication with the first compartment via at least one orifice. The second compartment may be configured to at least partially receive an applicator, and define a volume which is substantially fixed. The device may include a closure element configured to close off the opening of the second compartment. The device may be configured so that the height of the device diminishes as the volume of the first compartment becomes reduced. The device may lack a bellows, and the device may also lack a biased piston (e.g., lack a piston biased by a spring).

In an additional aspect, a method of applying a cosmetic product may include providing the device for applying a product, reducing the volume of the first compartment so as transfer at least a portion of the cosmetic product from the first compartment to the second compartment, and applying at least a portion of the cosmetic product to a body portion (e.g., hair and/or skin) using the applicator. In another aspect, the method may include removing the applicator from the second compartment. The applicator may be attached to the second compartment, and the method may include removing the closure element so as to expose the applicator. In another aspect, the device may include a piston associated with the first compartment, and the method may include reducing the volume of the first compartment via moving the piston in the first compartment. The reducing the volume of the first compartment may include moving at least a portion of the first compartment toward the second compartment. Moving at least a portion of the first compartment toward the second compartment may include moving the at least a portion of the first compartment in a non-rotating manner relative to the second compartment. In still another aspect, moving at least a portion of the first compartment toward the second compartment may include rotating the first compartment and the second compartment relative to each other. In yet an additional aspect, the device may include an actuator interconnecting the first compartment to the second compartment, and rotating the first compartment and the second compartment relative to each other may include rotating one of the first compartment and the second compartment relative to the actuator. Some exemplary methods may be suited for applying products having, for example, a high viscosity, such as some hair products, care products, and/or make-up products.

According to a further aspect of the invention, the device may include a reservoir configured to be closed, for example, via a piston, and be configured to constitute a refill element that may be fitted to the second housing (i.e., the housing to at least partially receive the applicator).

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is an exploded perspective view of an embodiment of a device for applying a product;

Reference will now be made in detail to some possible embodiments of the invention, examples of which are illustrated in the accompanying drawings. Wherever possible, the same reference numbers are used in the drawings and the description to refer to the same or like parts.

Figure 1:
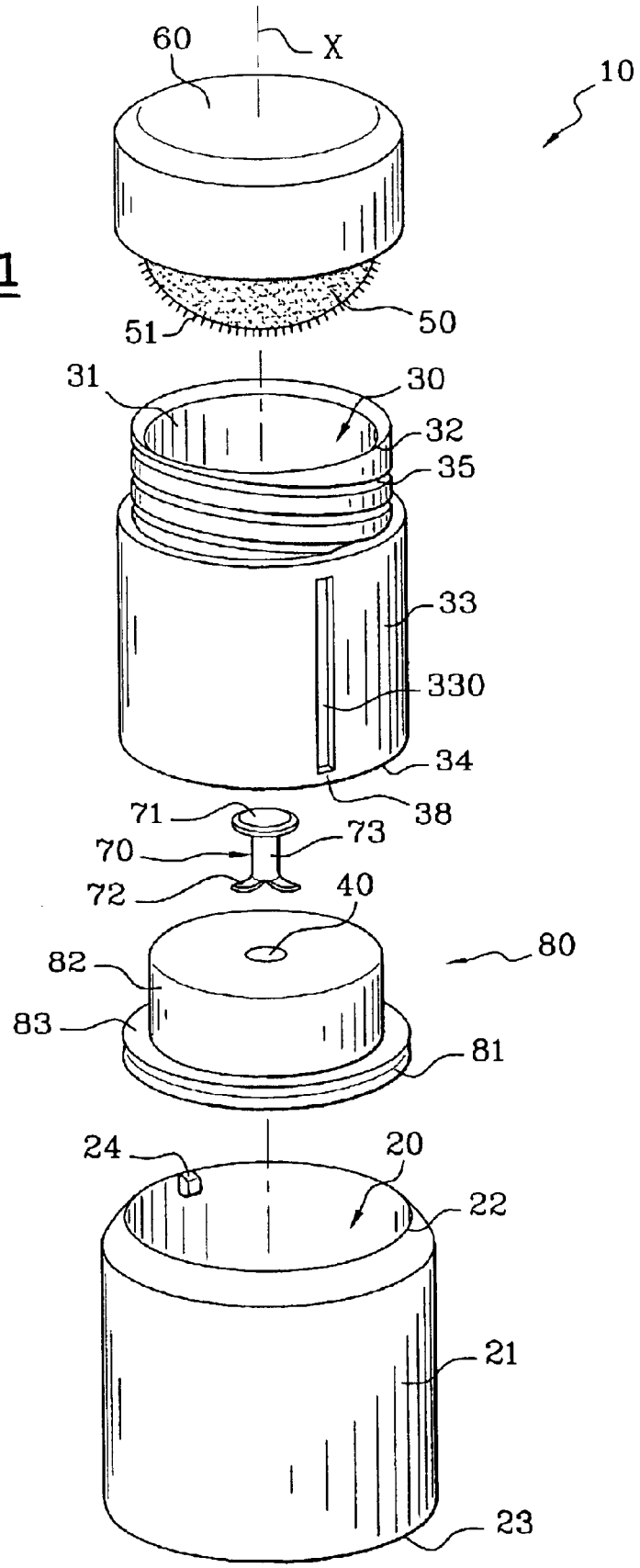
Figure 2:
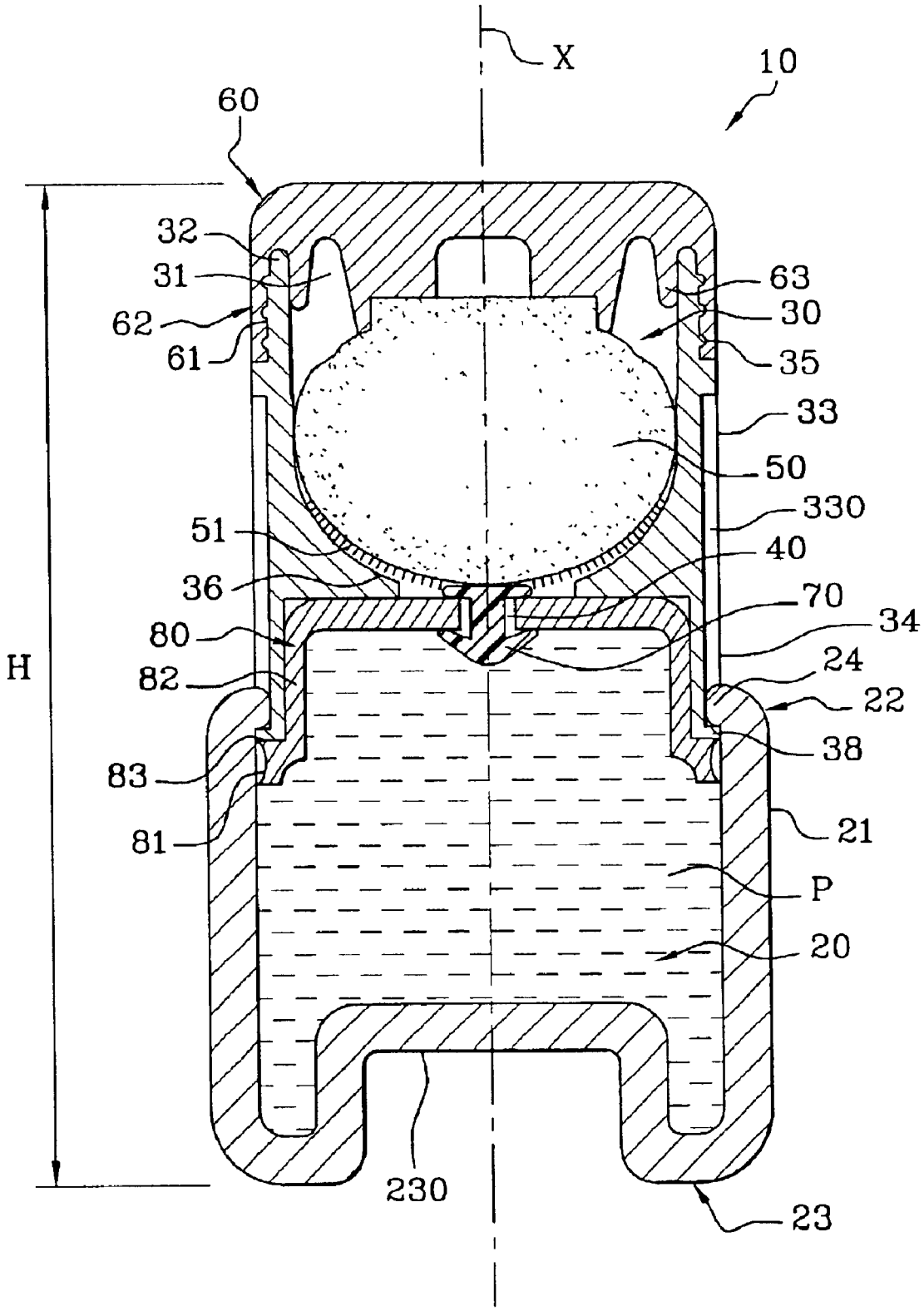
FIG. 2 is a schematic cross-section view of the device of FIG. 1 in a first condition.
Figure 3:
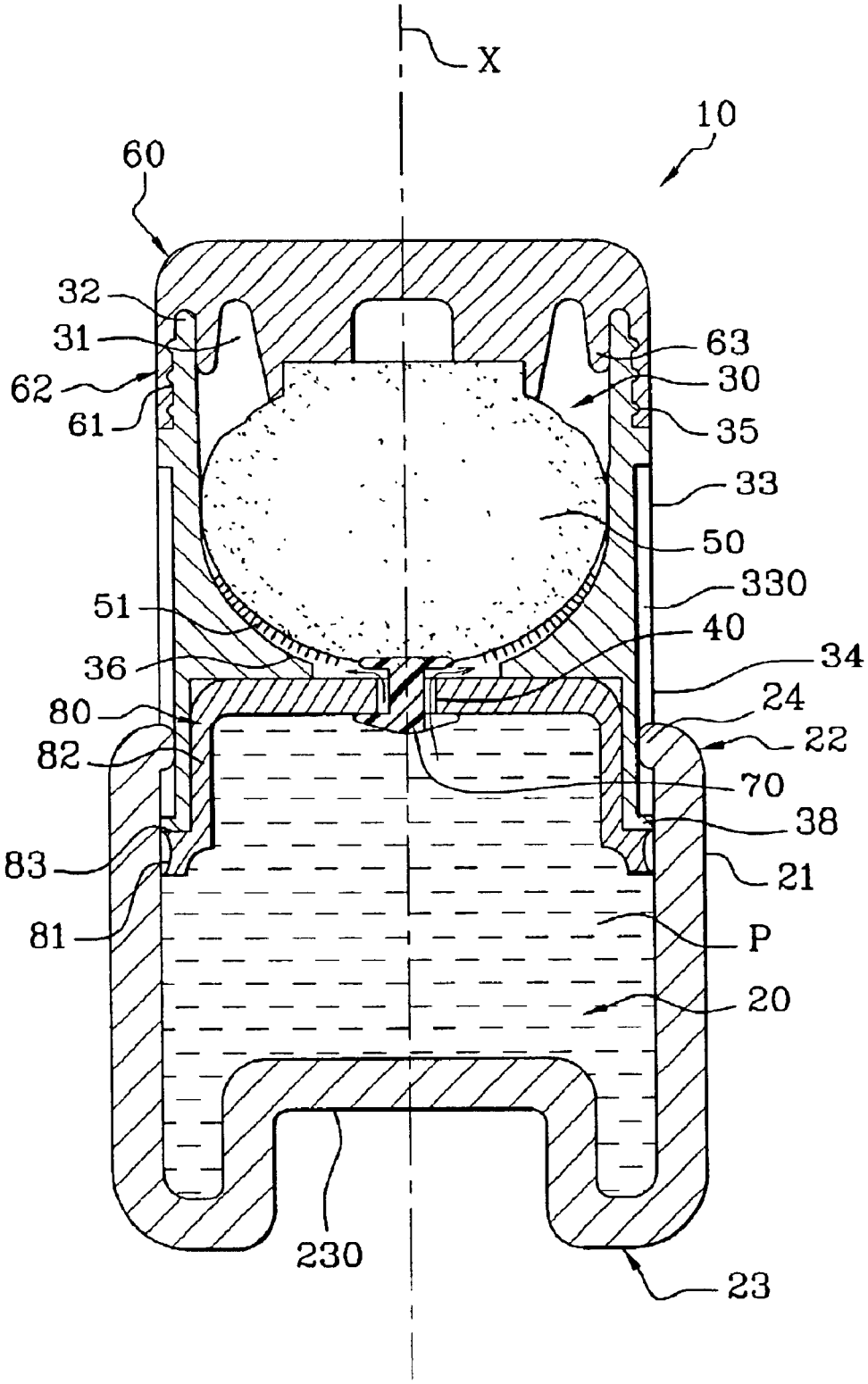
FIG. 3 is a schematic cross-section view of the device of FIG. 1 in a second condition.

The device 10 depicted in FIGS. 1 through 3 may be formed having a reservoir 20 containing a product P. A housing 30 for an applicator 50 may be mounted on the device 10. The applicator 50, for example, may be integral with an end-piece 60 (e.g., a cap) provided for closing the housing 30 in a substantially leak-tight manner. The reservoir 20 and the housing 30 may communicate via an opening 40 that may allow the passage of the product P coming from the reservoir 20. The device 10 defines an axial height H which diminishes as the device 10 is used.

The reservoir 20 may comprise, for example, polypropylene, and may have a substantially cylindrical shape defining a longitudinal axis X, although other shapes are contemplated. The reservoir 20 may comprise a lateral wall 21 having a first end 22 which may be open. Opposite the first end 22, the reservoir 20 includes a second end which may be closed by a base 23 which may include a recess 230 as viewed from the exterior of the device. An inner surface of the lateral wall 21 may include beadings 24 (e.g., two diametrically opposed beadings) arranged at the first end 22 of the reservoir 20. These beadings 24 may interact with portions of the housing 30 in a manner that will be detailed below.

The housing 30 may comprise, for example, polypropylene, and may have a substantially cylindrical shape (although other shapes are contemplated) defining a longitudinal axis X. The housing 30 may be defined by a lateral wall 33 formed, for example, as a single piece having a base 36 (e.g., a base of hemispherical shape), into which one end of the passage 40 may open out. The lateral wall 33 may extend beyond the base 36 via, for example, an extension 34 (e.g., a skirt). One end of the extension 34 may be intended for housing in the reservoir 20. An outer surface of the lateral wall 33 and extension 34 may include two grooves 330 (e.g., longitudinal grooves). The grooves 330 may be provided in order to receive the beadings 24 of the reservoir 20. The grooves 330 may not extend over substantially the entire axial height of the outer surface of the lateral wall 33 of the housing 30. Thus, a portion 38 of the lateral wall 33 that may be located below the groove 330 may form a stop for the beadings 24 so as to keep the reservoir 20 and the housing 30 of the applicator 50 linked together, and may prevent unintended opening of the reservoir 20. The housing 30 may slide within the reservoir 20, for example, substantially without friction with the inner surface of the lateral wall 21 of the reservoir 20. The housing 30 may be mounted in the reservoir 20, for example, via snap-fitting, although other methods of mounting the housing 30 in the reservoir 20 are contemplated.

The upper end of the housing 30, opposite the base 36, may form a free edge 32 delimiting an opening 31. The outer surface of the housing 30 may include, for example, a screw thread 35 intended for interacting with a corresponding screw thread 61 provided on an inner surface of an extension 62 (e.g., a skirt) of an end-piece 60. The end-piece 60 may comprise a sealing skirt 63 provided in order to be accommodated on the inner surface of the lateral wall 33 of the housing 30. In the closed position of the end-piece 60, the housing 30 may be substantially sealed.

The end-piece 60 may be integral with an applicator 50, for example, in the form of a block of open-cell foam shaped so as to substantially correspond to a hemispherical profile that may be defined by the base 36 of the housing 30. At least a portion of the surface of the applicator 50 may be covered with, for example, a flocking 51. The applicator 50 may be secured to the end-piece 60 via, for example, adhesive bonding.

The applicator 50 may be dimensioned relative to the housing 30 such that, in a closed position of the end-piece 60, at least a portion of the surface of the applicator 50 (e.g., the application surface) may be in contact with the base 36. With the end-piece 60 in this position, the applicator 50 may not be substantially compressed, for example, in an axial direction.

A piston 80 may extend over substantially the entire transverse cross-section of the reservoir 20, and may form a sealing lip 81 that is configured to slide over the inner surface of the lateral wall 21 of the reservoir 20. The piston 80 may be provided, for example, at its periphery, with an axial portion 82 that may extend toward the inside of the reservoir 20. The extension 34 of the housing 20 may be, for example, clipped around the axial portion 82 so as to securely hold the piston 80 and the housing 30 together.

The opening 40 allowing passage of the product P may be defined in the piston 80. A valve 70, for example, a valve comprising an elastomeric material, may be fitted in the opening 40. The valve 70 may be a one-way valve (e.g., a valve that opens in only one direction only when an overpressure is created in the reservoir 20). Valve 70 may include a substantially planar portion 71 capable of closing the opening 40 in a substantially leak-tight manner, and the substantially planar portion may be arranged on the side of opening 40 located closer to the base 36 of the housing 30. The valve 70 may be provided with, for example, three elastically deformable tabs 72 that may be positioned on the side of the opening 40 closer to the reservoir 20. The planar portion 71 and the tabs 72 may be connected by a rod 73 that may be positioned inside the opening 40. In a rest position, the planar portion 71 may rest on the piston 80, thereby substantially covering the entire periphery of the opening 40. When an overpressure is created inside the reservoir 20, the tabs 72 of the valve 70 may deform slightly such that the rod 73 slides within the opening 40 and such that the planar portion 71 separates from the piston 80.

During use of the device 10, the user may press on the end-piece 60, for example, in the manner of a push-button, when the end-piece is in the closed position on the housing 30. The force exerted on the end-piece 60 may be transmitted to the piston 80 via the wall forming the housing 30 which may be integral with the piston 80. As a result, the lip 81 of the piston 80 may slide along the lateral wall 21 of the reservoir 20 such that the unit (e.g., a removable satellite-like configuration that can be associated with the remainder of the device) formed by the end-piece 60, the applicator 50, and the housing 30, and in some embodiments, the piston 80, may be displaced toward the reservoir 20, as shown in FIG. 3. An overpressure condition may be created inside the reservoir 20, which may give rise to opening of the valve 70. A quantity of product P may be pushed from the reservoir 20 toward the applicator 50 via the opening 40. The quantity of product P may be received by the applicator 50 (e.g., a foam applicator). The volume of product P evacuated from the reservoir 20 may serve to re-establish the reduced pressure inside the reservoir 20 so that the valve 70 closes. The user may then open the end-piece 60 and apply the product P loaded in the applicator 50 onto the surface to be treated. When the unit is displaced toward the reservoir 20, the beadings 24 may be displaced in the grooves 330 so as to substantially prevent relative rotational movement of the reservoir 20 with respect to the unit.

The user can close the device 10 in a substantially leak-tight manner and recommence operation of the device 10, for example, for one or more additional uses. It should be noted that substantially all the product P contained in the reservoir 20 may be used, for example, in embodiments of reservoirs 20 provided with a base at least similar to a base 23 having a shape that may substantially complement that of the piston 80, for example, by virtue of the presence of a recess 230 formed in the base 23 of the reservoir 20.

Figure 4:
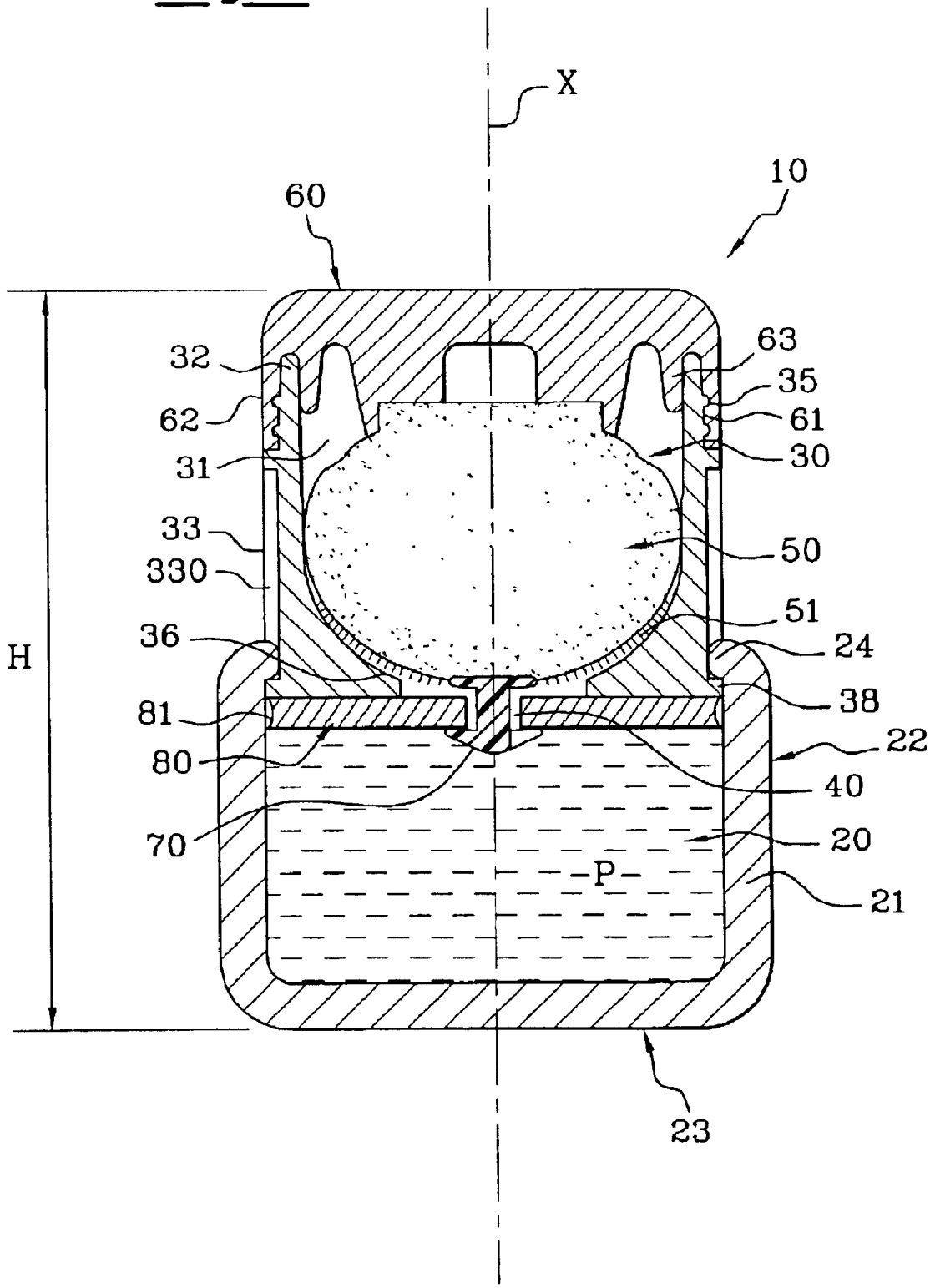
FIG. 4 is a schematic cross-section view of another embodiment of a device for applying a product.

FIG. 4 depicts another exemplary embodiment of a device 10 which differs from the exemplary embodiment shown in FIGS. 1 through 3 in that the piston 80 may have no axial portion. Instead the piston 80 may extend over substantially the entire transverse cross-section of the reservoir 20. The base 23 of the reservoir 20 may be a simple transverse wall that, for example, does not have recess. For example, in some embodiments, the lateral wall 33 of the housing 30 may not extend beyond the base 36.

According to this embodiment shown in FIG. 4, the piston 80 may be integral with the housing 30. For example, the upper surface of the piston 80 may be adhesively bonded to the lower surface of the base of the housing 30. Alternatively, the base of the housing 30 may simply abut against the piston 80.

Figure 5:
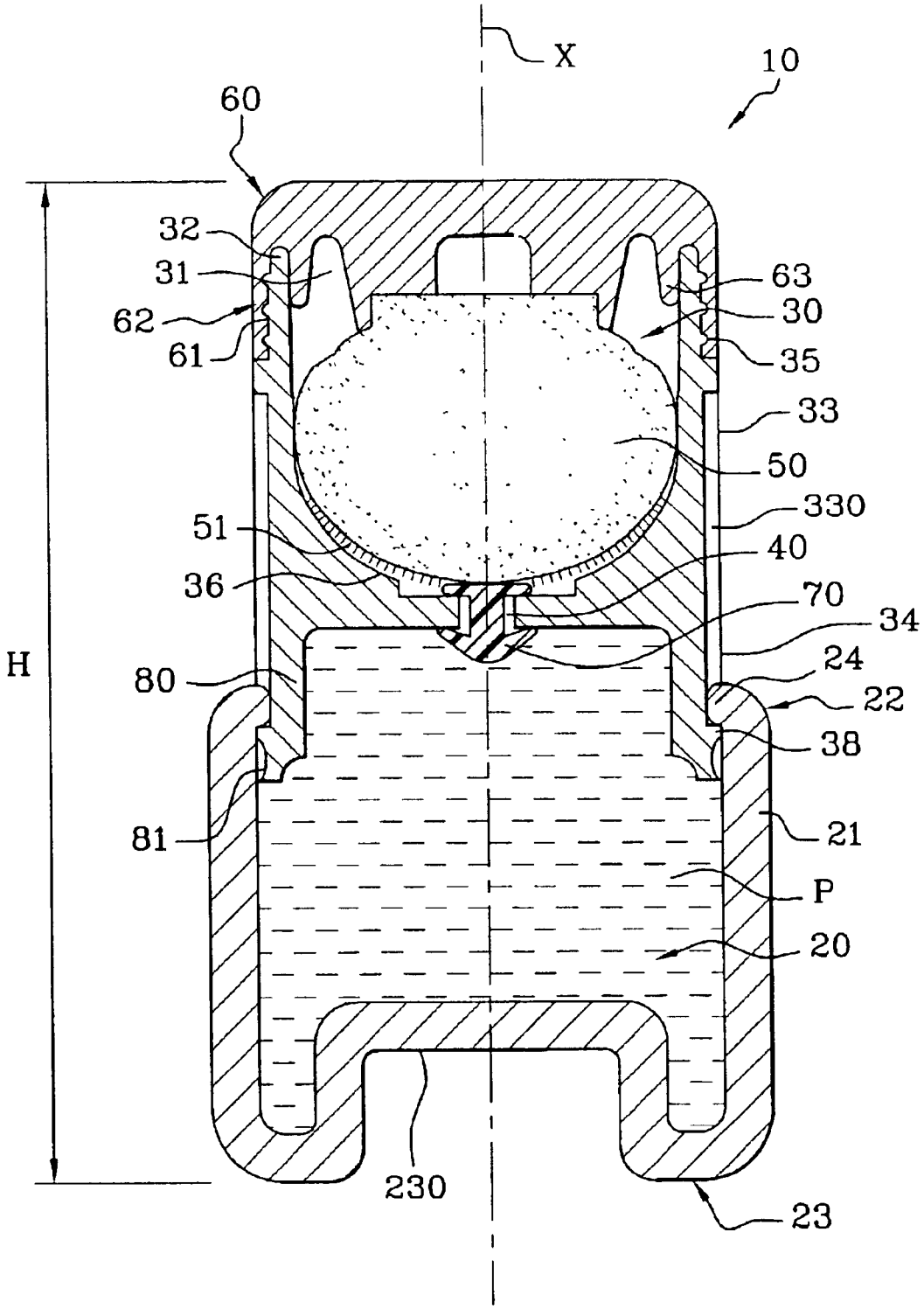
FIG. 5 is a schematic cross-section view of another embodiment of a device for applying a product.

FIG. 5 depicts another exemplary embodiment that differs from the embodiment described in association with FIGS. 1 through 3 in that the piston 80 and the lateral wall 33 of the housing 30 may be formed as a single piece. The lip 81 may be formed at the periphery of the extension 34 of the lateral wall 33 of the housing 30.

According to this exemplary embodiment, the opening 40 may be formed in the base 36 of the housing 30. According to a variant (not shown) of this embodiment, it may be possible to provide the lateral wall 33 of the housing 30 in a manner that is not extended by an extension 34, for example, in a manner similar to that of the embodiment shown in FIG. 4. The lip 81 may be formed at the periphery of the base 36 of the housing 30. The base 23 of the reservoir 20 may be provided without a recess.

Figure 6:
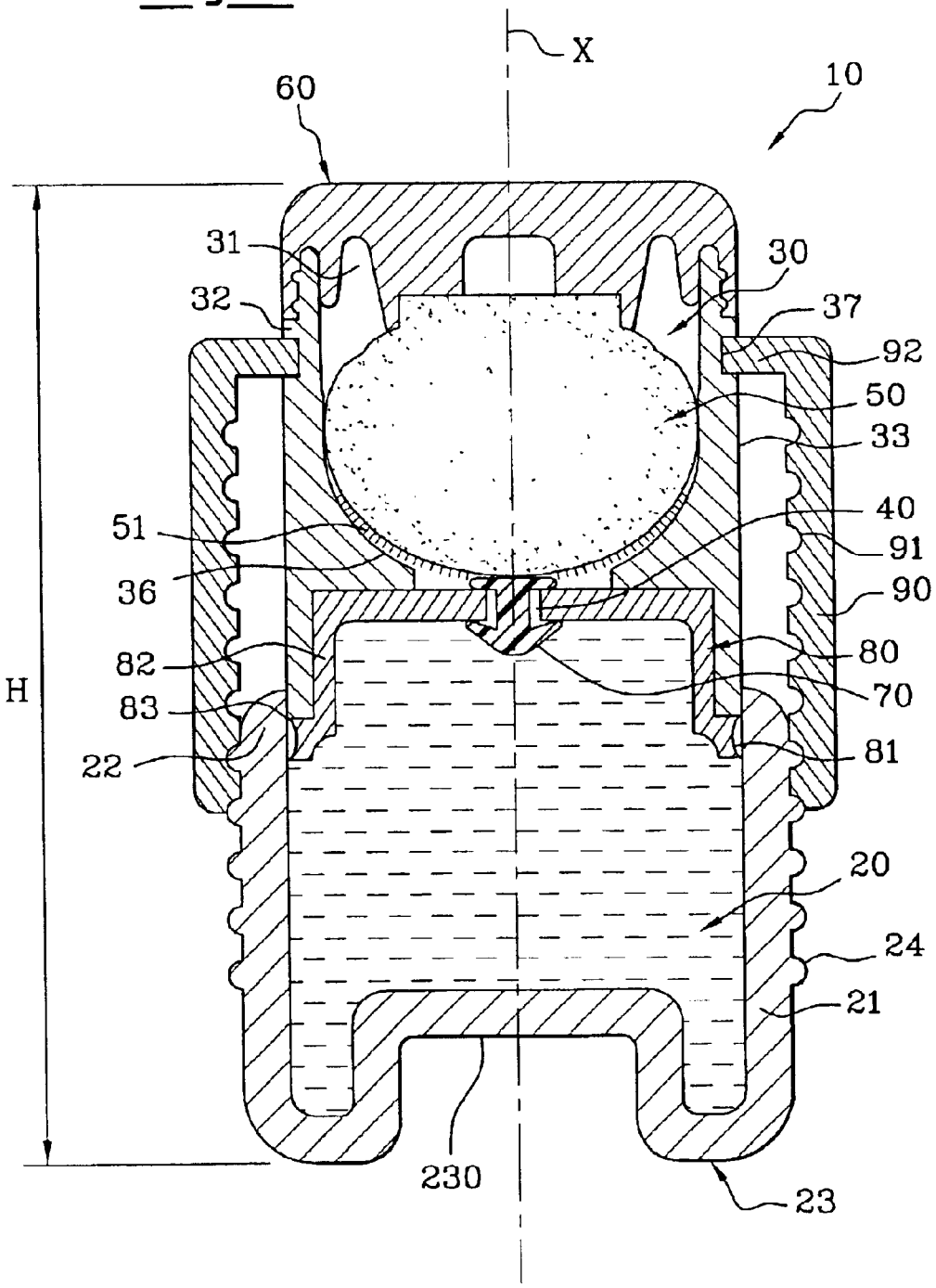
FIG. 6 is a schematic cross-section view of yet another embodiment of a device for applying a product.

FIG. 6 depicts another exemplary embodiment that may differ from the embodiments described in association with FIGS. 1 through 3 in that it comprises an actuator 90 that is distinct from the end-piece 60. The actuator may be in the form of an annular ring having an inner surface provided with a screw thread 91 that interacts with a complementary screw thread 24 that may be provided on the outer surface of the lateral wall 21 of the reservoir 20. An annular protuberance 92 may extend toward the inside of the annular ring 90 and may be housed in a complementary cavity 37 provided on the outer surface of the lateral wall 33 of the housing 30. Threading of the annular ring 90 onto the reservoir 20 causes the unit to be displaced toward the reservoir 20.

According to this exemplary embodiment, the reservoir 20 may be filled with the product P and the piston 80 may be fitted, with or without valve 70, thereby forming a refill for the device 10. Independent of the remainder of the assembly, this refill may be covered with a protective film that may be, for example, heat-sealed over the outer surface of the piston 80 in order to close the opening 40 in a substantially leak-tight manner. Thus, once a first reservoir 20 containing product P becomes empty, the user may remove it from the remainder of the device 10, remove the protective film from a refill, and fit the refill to the remainder of the device 10.

Figure 7:
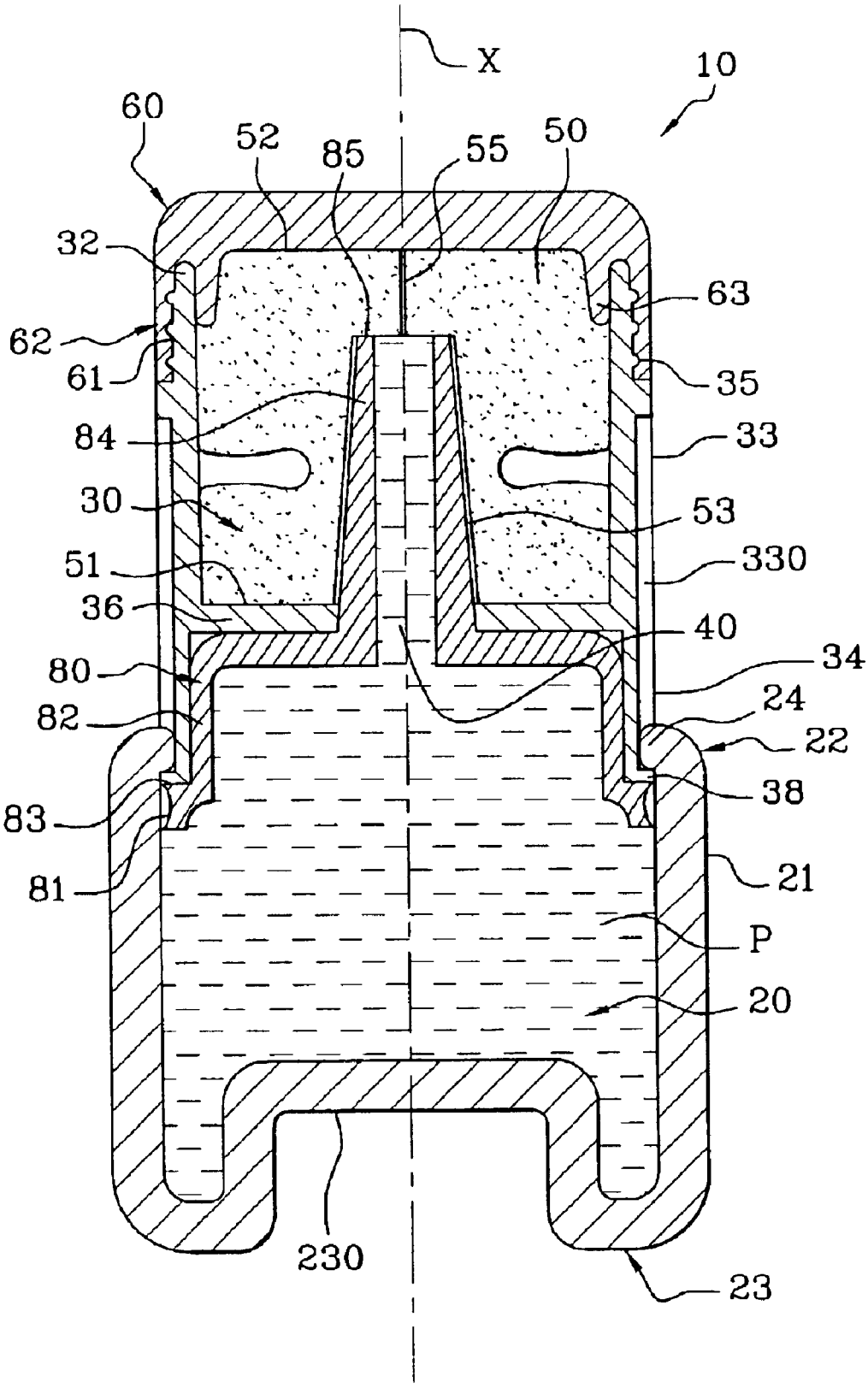
FIG. 7 is a schematic cross-section view of an additional embodiment of a device in a first condition.
Figure 8:
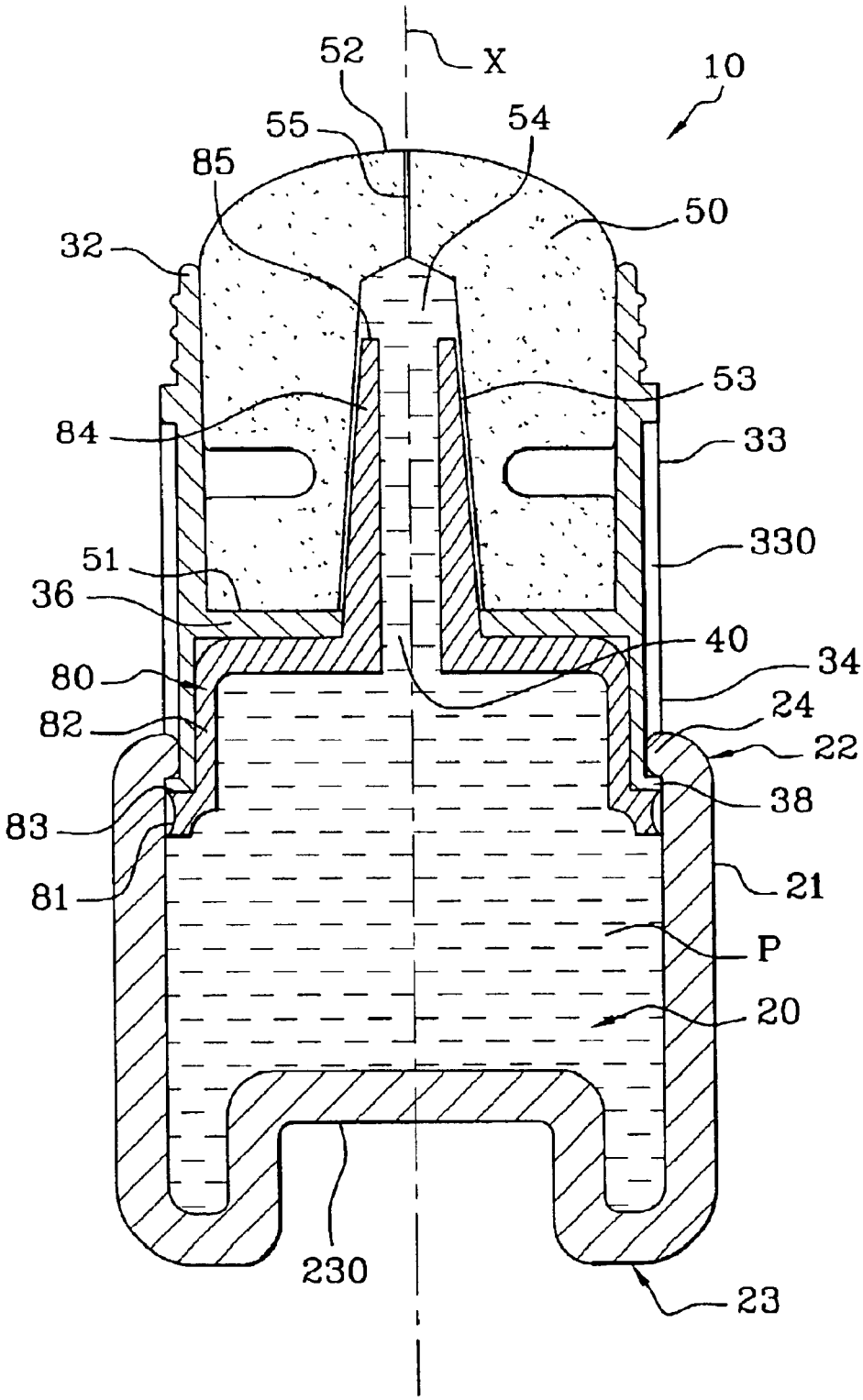
FIG. 8 is a schematic cross-section view of the device of FIG. 7 in a second condition.

FIGS. 7 and 8 depict an exemplary embodiment of a device 10 that differs from that described in association with FIGS. 1 through 3, for example, in that the applicator 50 may not be integral with the end-piece 60. For example, the applicator 50 may be integral with the base 36 of the housing 30. The base 36 of the housing 30 may be a substantially planar surface onto which the applicator 50 may be, for example, adhesively bonded. The base 36 may also have configurations other than a substantially planar surface.

According to this exemplary embodiment, the opening 40 may be defined by a shaft 84 (e.g., an axial shaft) that extends from the piston 80 to a free end 85 that may be located substantially inside the housing 30. The shaft 84 and the piston 80 may be formed as a single piece in some embodiments, and may allow passage of the product P from the reservoir 20 into the housing 30.

The applicator 50 may be fitted inside the housing 30 substantially around the shaft 84. The applicator 50 may have a first end 51, for example, adhesively bonded onto the base 36 of the housing 30, and may have a second end 52, opposite the first end, that may provide an application surface (e.g., a dome-shaped application surface). When the applicator 50 is fitted in the housing 30, it may occupy substantially all of the housing 30, and the applicator may have a shape that substantially complements the shape of the housing 30. The applicator 50 may have, for example, an axial recess 53 that may be configured such that the applicator 50 can bear on the wall of the shaft 84 without being substantially compressed laterally by the shaft 84. For example, with the applicator 50 in a relaxed position as show in FIG. 8, the axial recess 53 may have an axial height that is substantially greater than the axial height of the shaft 84 so as to define an inner cavity 54 above the free end 85 of the shaft 84. The cavity 54 may serve as a reservoir for product P in relatively close proximity to the application surface. In some exemplary embodiments, the product P from the reservoir 20 may contact the applicator 50 only in the region of cavity 54. In order to increase the dispensing flow rate of the product P toward the application surface, an axial slot 55 may be provided in the applicator 50, for example, along the axis X from the cavity 54 to the second end (e.g., the application surface) of the applicator 50. The width of the slot 55 may vary, for example, as a function of the viscosity of the product P and/or as a function of the desired flow rate.

When the user presses on the end-piece 60, the satellite formed by the end-piece 60, the applicator 50, and its housing 30, and, in some embodiments, the piston 80, may be displaced toward the reservoir 20, thereby creating an overpressure inside the reservoir 20. The overpressure may transfer the product P into the shaft 84. The user may open the end-piece 60 (e.g., a stopper) so that the applicator 50 substantially relaxes, as shown in FIG. 8. The second end 52 (e.g., the application surface) may emerge from the housing 30. Decompression of the applicator 50 may cause the formation of cavity 54 and the transfer of the product P into the cavity 54. The product P may be pumped into the applicator 50 (e.g., into the cells of, for example, a foam) that may be located in the vicinity of the cavity 54. That portion of the applicator 50 that is located between the cavity 54 and the second end 52 of the applicator 50 may become saturated with product P. In this manner, the user may be able to hold the unit and apply the product P to the zone to be treated via, for example, the second end 52 of the applicator 50.

In particular, the shape of the applicator 50 may be different from the shape illustrated with reference to the embodiments just described. For example, the shape of the applicator 50 may be chosen as a function of the zone to be treated. In the case of an applicator for the lips, for example, the applicator may be substantially cone-shaped.

The device according to some exemplary embodiments of the invention may be used to apply cosmetic products, such as care products, make-up products, dermatological substances, and/or pharmaceutical compositions used for treating and/or changing the appearance and/or scent of hair or skin. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics. For example, the shape of the applicator may be different from the shape illustrated with reference to the embodiments just described. The shape of the applicator may be selected as a function of the zone to be treated. For example, in the case of an applicator for the lips, for example, a substantially cone-shaped applicator may be used.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product, the device defining a height and comprising:

a first compartment defining a reservoir for containing a product, wherein the first compartment has a variable volume;

a second compartment defining an opening and being in one of selective and permanent flow communication with the first compartment via at least one orifice, the second compartment being configured to at least partially receive an applicator for applying the product, and defining a volume which is substantially fixed; and a closure element configured to close off the opening of the second compartment, wherein the device is configured so that the height of the device diminishes as the volume of the first compartment becomes reduced, wherein, at a last use of the device, the axial height of the device is less than the axial height of the device at a first use of device, wherein an interior of the second compartment is sealed in a substantially product-tight manner with respect to the exterior of the device when the closure element closing the opening of the second compartment, and wherein the first compartment defines a cross-section that remains substantially constant when the volume of the first compartment is reduced.

2. The device of claim 1, wherein the closure element is configured to seal the opening of the second compartment in a substantially product-tight manner.

3. The device of claim 1, wherein the closure element is configured to seal the opening of the second compartment in a substantially air-tight manner.

4. The device of claim 1, further comprising a piston configured to slide axially in the first compartment in response to a force exerted on the second compartment.

5. The device of claim 4, wherein the piston is configured to slide inside the first compartment in response to a force exerted on the closure element.

6. The device of claim 4, wherein the first compartment comprises an outer wall, the second compartment comprises a lateral wall, and the device further comprises an actuator comprising a screw thread, the actuator being integral with the lateral wall of the second compartment, and the screw thread being configured to interact with the outer wall of the first compartment so as to cause the piston to slide inside the first compartment in response to threading the actuator onto the first compartment.

7. The device of claim 4, wherein the second compartment comprises a lateral wall, and wherein the piston and lateral wall of the second compartment are formed as a single piece.

8. The device of claim 4, wherein the second compartment comprises a lateral wall, and wherein the piston is integral with the lateral wall of the second compartment.

9. The device of claim 8, wherein the piston and the lateral wall are connected to one another via at least one of adhesive bonding and clasping.

10. The device of claim 4, wherein the second compartment comprises a lateral wall, and wherein the piston comprises an axial set-back substantially surrounded by an extension of the lateral wall of the second compartment.

11. The device of claim 4, wherein the piston and the second compartment each define a cross-section, wherein the cross-section of the piston is substantially identical to the cross-section of the second compartment.

12. The device of claim 4, wherein the first compartment comprises an inner wall and the piston forms a sealing lip configured to slide along the inner wall of the first compartment.

13. The device of claim 1, further comprising means for keeping the first and second compartments linked together.

14. The device of claim 1, further comprising a one-way valve configured to close the orifice, wherein the one-way valve is configured to open to permit product flow toward the second compartment in response to an overpressure generated in the first compartment.

15. The device of claim 14, wherein the one-way valve comprises one of a flap valve and a ball valve.

16. The device of claim 1, further comprising an applicator configured to be received at least partially in the second compartment.

17. The device of claim 16, wherein the applicator is fixedly attached to the closure element.

18. The device of claim 17, wherein the applicator is fixedly attached to the closure element via at least one of adhesive bonding, welding, and pinching.

19. The device of claim 16, wherein the closure element is configured to provide a gripping surface for the applicator.

20. The device of claim 16, wherein the second compartment comprises a wall and the applicator is fixedly attached to the wall of the second compartment.

21. The device of claim 16, wherein the applicator is fixedly attached to the wall of the second compartment via at least one of adhesive bonding, welding, and pinching.

22. The device of claim 16, wherein the applicator is at least one of configured to be loaded with cosmetic product at its surface and configured to be loaded with cosmetic product through its depth.

23. The device of claim 22, wherein at least a portion of the applicator comprises a porous material.

24. The device of claim 22, wherein at least a portion of the applicator is formed of a material selected from sintered materials, thermoplastic materials, ceramic materials, felts, elastically compressible materials, foams having closed cells, foams having open cells, foams having semi-open cells, and elastomers.

25. The device of claim 24, wherein the applicator comprises a superposition of layers.

26. The device of claim 16, wherein at least a portion of a surface of the applicator is covered with a flocking.

27. The device of claim 26, wherein the flocking comprises at least one of rayon fibers, cotton fibers, viscose fibers, nylon fibers, a woven covering, and a non-woven covering.

28. The device of claim 16, wherein the second compartment defines an inner wall, and the applicator contacts at least a portion of the inner wall of the second compartment.

29. The device of claim 28, wherein the inner wall defines a base of the second compartment and the applicator contacts the base of the second compartment.

30. The device of claim 16, further comprising a cosmetic product contained in the first compartment.

31. A method of applying a cosmetic product, the method comprising:

providing the device of claim 30;

reducing the volume of the first compartment so as transfer at least a portion of the cosmetic product from the first compartment to the second compartment; and applying at least a portion of the cosmetic product to a body portion using the applicator.

32. The method of claim 31, further comprising removing the applicator from the second compartment.

33. The method of claim 31, wherein the applicator is attached to the second compartment, and the method further comprises removing the closure element so as to expose the applicator.

34. The method of claim 31, wherein the device further comprises a piston associated with the first compartment, wherein reducing the volume of the first compartment comprises moving the piston in the first compartment.

35. The method of claim 31, wherein reducing the volume of the first compartment comprises moving at least a portion of the first compartment toward the second compartment.

36. The method of claim 35, wherein moving at least a portion of the first compartment toward the second compartment comprises moving the at least a portion of the first compartment in a non-rotating manner relative to the second compartment.

37. The method of claim 35, wherein moving at least a portion of the first compartment toward the second compartment comprises rotating the first compartment and the second compartment relative to each other.

38. The method of claim 37, wherein the device further comprises an actuator interconnecting the first compartment to the second compartment, and wherein the rotating the first compartment and the second compartment relative to each other comprises rotating one of the first compartment and the second compartment relative to the actuator.

39. A device for applying a product, the device defining a height and comprising:

a first compartment defining a reservoir configured to contain a product, wherein the first compartment has a variable volume;

a second compartment defining an opening and being in one of selective and permanent flow communication with the first compartment via at least one orifice, the second compartment being configured to at least partially receive an applicator, and defining a volume which is substantially fixed;

a closure element configured to close off the opening of the second compartment; and an applicator configured to be received at least partially in the second compartment, wherein the device is configured so that the height of the device diminishes as the volume of the first compartment becomes reduced, wherein the device is configured so that the first compartment does not resiliently expand to increase its volume after the volume of the first compartment becomes reduced, wherein the applicator is at least one of configured to be loaded with cosmetic product at its surface and configured to be loaded with the cosmetic product through its depth, and wherein at least a portion of the applicator comprises a porous material.

40. The device of claim 39, wherein the closure element is configured to seal the opening of the second compartment in a substantially product-tight manner.

41. The device of claim 39, wherein the closure element is configured to seal the opening of the second compartment in a substantially air-tight manner.

42. The device of claim 39, further comprising a piston configured to slide axially in the first compartment in response to a force exerted on the second compartment.

43. The device of claim 42, wherein the piston is configured to slide inside the first compartment in response to a force exerted on the closure element.

44. The device of claim 42, wherein the first compartment comprises an outer wall, the second compartment comprises a lateral wall, and the device further comprises an actuator comprising a screw thread, the actuator being integral with the lateral wall of the second compartment, and the screw thread being configured to interact with the outer wall of the first compartment so as to cause the piston to slide inside the first compartment in response to threading the actuator onto the first compartment.

45. The device of claim 42, wherein the second compartment comprises a lateral wall, and wherein the piston and the lateral wall of the second compartment are formed as a single piece.

46. The device of claim 42, wherein the second compartment comprises a lateral wall, and wherein the piston is integral with the lateral wall of the second compartment.

47. The device of claim 46, wherein the piston and the lateral wall are connected to one another via at least one of adhesive bonding and clasping.

48. The device of claim 42, wherein the second compartment comprises a lateral wall, and wherein the piston comprises an axial set-back substantially surrounded by an extension of the lateral wall of the second compartment.

49. The device of claim 42, wherein the piston and the second compartment each define a cross-section, wherein the cross-section of the piston is substantially identical to the cross-section of the second compartment.

50. The device of claim 42, wherein the first compartment comprises an inner wall and the piston forms a sealing lip configured to slide along the inner wall of the first compartment.

51. The device of claim 39, further comprising means for keeping the first and second compartments linked together.

52. The device of claim 39, further comprising a one-way valve configured to close the orifice, wherein the one-way valve is configured to open to permit product flow toward the second compartment in response to an overpressure generated in the first compartment.

53. The device of claim 52, wherein the one-way valve comprises one of a flap valve and a ball valve.

54. The device of claim 39, wherein the applicator is fixedly attached to the closure element.

55. The device of claim 54, wherein the applicator is fixedly attached to the closure element via at least one of adhesive bonding, welding, and pinching.

56. The device of claim 39, wherein the closure element is configured to provide a gripping surface for the applicator.

57. The device of claim 39, wherein the second compartment comprises a wall and the applicator is fixedly attached to the wall of the second compartment.

58. The device of claim 57, wherein the applicator is fixedly attached to the wall of the second compartment via at least one of adhesive bonding, welding, and pinching.

59. The device of claim 39, wherein at least a portion of the applicator is formed of a material selected from sintered materials, thermoplastic materials, ceramic materials, felts, elastically compressible materials, foams having closed cells, foams having open cells, foams having semi-open cells, and elastomers.

60. The device of claim 59, wherein the applicator comprises a superposition of layers.

61. The device of claim 39, wherein at least a portion of a surface of the applicator is covered with a flocking.

62. The device of claim 61, wherein the flocking comprises at least one of rayon fibers, cotton fibers, viscose fibers, nylon fibers, a woven covering, and a non-woven covering.

63. The device of claim 39, wherein the second compartment defines an inner wall, and the applicator contacts at least a portion of the inner wall of the second compartment.

64. The device of claim 63, wherein the inner wall defines a base of the second compartment and the applicator contacts the base of the second compartment.

65. The device of claim 39, further comprising a product contained in the first compartment.

66. The device of claim 65, wherein the product comprises a cosmetic product.

67. The device of claim 66, wherein the cosmetic product comprises at least one of a liquid, a milk, a cream, and a gel.

68. A method of applying a product, the method comprising:

providing the device of claim 66;

reducing the volume of the first compartment so as transfer at least a portion of the product from the first compartment to the second compartment; and applying at least a portion of the cosmetic product to a body portion using the applicator.

69. The method of claim 68, further comprising removing the applicator from the second compartment.

70. The method of claim 68, wherein the applicator is attached to the second compartment, and the method further comprises removing the closure element so as to expose the applicator.

71. The method of claim 68, wherein the device further comprises a piston associated with the first compartment, and reducing the volume of the first compartment comprises moving the piston in the first compartment.

72. The method of claim 68, wherein reducing the volume of the first compartment comprises moving at least a portion of the first compartment toward the second compartment.

73. The method of claim 72, wherein moving at least a portion of the first compartment toward the second compartment comprises moving the at least a portion of the first compartment in a non-rotating manner relative to the second compartment.

74. The method of claim 72, wherein moving at least a portion of the first compartment toward the second compartment comprises rotating the first compartment and the second compartment relative to each other.

75. The method of claim 74, wherein the device further comprises an actuator interconnecting the first compartment to the second compartment, and wherein the rotating the first compartment and the second compartment relative to each other comprises rotating one of the first compartment and the second compartment relative to the actuator.

76. A device for applying a product, the device defining a height and comprising:

a first compartment defining a reservoir for containing a product, wherein the first compartment has a variable volume;

a second compartment defining an opening and being in one of selective and permanent flow communication with the first compartment via at least one orifice, the second compartment being configured to at least partially receive an applicator, and defining a volume which is substantially fixed;

a closure element configured to close off the opening of the second compartment; and a piston configured to slide in the first compartment, wherein the device is configured so that the height of the device diminishes as the volume of the first compartment becomes reduced, and wherein the device lacks a structure biasing the piston.

77. The device of claim 76, wherein the piston is configured to slide inside the first compartment in response to a force exerted on the closure element.

78. The device of claim 76, further comprising means for keeping the first and second compartments linked together.

79. The device of claim 76, further comprising a one-way valve configured to close the orifice, wherein the one-way valve is configured to open to permit product flow toward the second compartment in response to an overpressure generated in the first compartment.

80. The device of claim 76, wherein the one-way valve comprises one of a flap valve and a ball valve.

81. The device of claim 76, further comprising an applicator configured to be received at least partially in the second compartment.

82. The device of claim 81, wherein the applicator is fixedly attached to the closure element.

83. The device of claim 82, wherein the applicator is fixedly attached to the closure element via at least one of adhesive bonding, welding, and pinching.

84. The device of claim 81, wherein the closure element is configured to provide a gripping surface for the applicator.

85. The device of claim 81, wherein the second compartment comprises a wall and the applicator is fixedly attached to the wall of the second compartment.

86. The device of claim 85, wherein the applicator is fixedly attached to the wall of the second compartment via at least one of adhesive bonding, welding, and pinching.

87. The device of claim 81, wherein the applicator is at least one of configured to be loaded with product at its surface and configured to be loaded with product through its depth.

88. The device of claim 81, wherein at least a portion of a surface of the applicator is covered with a flocking.

89. The device of claim 81, wherein the second compartment defines an inner wall, and the applicator contacts at least a portion of the inner wall of the second compartment.

90. The device of claim 89, wherein the inner wall defines a base of the second compartment and the applicator contacts the base of the second compartment.

91. The device of claim 81, further comprising a cosmetic product contained in the first compartment.

92. The device of claim 91, wherein the cosmetic product comprises at least one of a liquid, a milk, a cream, and a gel.

93. A method of applying a product, the method comprising:

providing the device of claim 91;

reducing the volume of the first compartment so as transfer at least a portion of the product from the first compartment to the second compartment; and applying at least a portion of the product to a body portion using the applicator.

94. The method of claim 93, further comprising removing the applicator from the second compartment.

95. The method of claim 93, wherein the applicator is attached to the second compartment, and the method further comprises removing the closure element so as to expose the applicator.

96. A device for applying a product, the device defining a height and comprising:

an applicator for applying a product;

a first compartment defining a reservoir configured to contain a product, wherein the first compartment has a variable volume;

a second compartment defining an opening, the second compartment being configured to at least partially receive the applicator for applying the product, and defining a volume which is substantially fixed;

a piston configured to slide in the first compartment;

a one-way valve configured to permit flow of product from the first compartment to the second compartment; and a closure element configured to close off the opening of the second compartment, wherein the device is configured so that the height of the device diminishes as the volume of the first compartment becomes reduced.

97. The device of claim 96, wherein the device is configured so that an overpressure in first compartment opens the one-way valve.

98. The device of claim 96, wherein the piston is configured to slide inside the first compartment in response to a force exerted on the closure element.

99. The device of claim 96, further comprising means for keeping the first and second compartments linked together.

100. The device of claim 96, wherein the one-way valve comprises one of a flap valve and a ball valve.

101. The device of claim 96, wherein the applicator is fixedly attached to the closure element.

102. The device of claim 101, wherein the applicator is fixedly attached to the closure element via at least one of adhesive bonding, welding, and pinching.

103. The device of claim 96, wherein the closure element is configured to provide a gripping surface for the applicator.

104. The device of claim 96, wherein the second compartment comprises a wall and the applicator is fixedly attached to the wall of the second compartment.

105. The device of claim 104, wherein the applicator is fixedly attached to the wall of the second compartment via at least one of adhesive bonding, welding, and pinching.

106. The device of claim 96, wherein the applicator is at least one of configured to be loaded with product at its surface and configured to be loaded with product through its depth.

107. The device of claim 96, wherein at least a portion of a surface of the applicator is covered with a flocking.

108. The device of claim 96, wherein the second compartment defines an inner wall, and the applicator contacts at least a portion of the inner wall of the second compartment.

109. The device of claim 108, wherein the inner wall defines a base of the second compartment and the applicator contacts the base of the second compartment.

110. The device of claim 96, further comprising a cosmetic product contained in the first compartment.

111. The device of claim 110, wherein the cosmetic product comprises at least one of a liquid, a milk, a cream, and a gel.

112. A method of applying a product, the method comprising:

providing the device of claim 110;

reducing the volume of the first compartment so as transfer at least a portion of the product from the first compartment to the second compartment; and applying at least a portion of the product to a body portion using the applicator.

113. The method of claim 112, further comprising removing the applicator from the second compartment.

114. The method of claim 112, wherein the applicator is attached to the second compartment, and the method further comprises removing the closure element so as to expose the applicator.

115. A device for applying a product, the device defining a height and comprising:

a first compartment defining a reservoir for containing a product, wherein the first compartment has a variable volume;

a second compartment defining an opening and being in one of selective and permanent flow communication with the first compartment via at least one orifice, the second compartment being configured to at least partially receive an applicator, and defining a volume which is substantially fixed; and a closure element configured to close off the opening of the second compartment, wherein the device is configured so that the height of the device diminishes as the volume of the first compartment becomes reduced, and wherein at least a portion of the second compartment is configured to slide within the first compartment.

116. The device of claim 115, wherein the closure element is configured to seal the opening of the second compartment in a substantially product-tight manner.

117. The device of claim 115, wherein the at least a portion of the second compartment configured to slide within the first compartment comprises a piston configured to slide axially in the first compartment in response to a force exerted on the second compartment.

118. The device of claim 117, wherein the piston is configured to slide inside the first compartment in response to a force exerted on the closure element.

119. The device of claim 115, further comprising a one-way valve configured to close the orifice, wherein the one-way valve is configured to open to permit product flow toward the second compartment in response to an overpressure generated in the first compartment.

120. The device of claim 115, further comprising an applicator configured to be received at least partially in the second compartment.

121. The device of claim 120, wherein the applicator is fixedly attached to the closure element.

122. The device of claim 121, wherein the applicator is fixedly attached to the closure element via at least one of adhesive bonding, welding, and pinching.

123. The device of claim 120, wherein the closure element is configured to provide a gripping surface for the applicator.

124. The device of claim 120, wherein the second compartment comprises a wall and the applicator is fixedly attached to the wall of the second compartment.

125. The device of claim 120, wherein the applicator is at least one of configured to be loaded with cosmetic product at its surface and configured to be loaded with cosmetic product through its depth.

126. The device of claim 120, wherein at least a portion of a surface of the applicator is covered with a flocking.

127. The device of claim 120, wherein the second compartment defines an inner wall, and the applicator contacts at least a portion of the inner wall of the second compartment.

128. The device of claim 127, wherein the inner wall defines a base of the second compartment and the applicator contacts the base of the second compartment.

129. The device of claim 120, further comprising a product contained in the first compartment.

130. The device of claim 129, wherein the product comprises a cosmetic product.

131. The device of claim 130, wherein the cosmetic product comprises at least one of a liquid, a milk, a cream, and a gel.

132. A method of applying a product, the method comprising:

providing the device of claim 130;

reducing the volume of the first compartment so as transfer at least a portion of the product from the first compartment to the second compartment; and applying at least a portion of the product to a body portion using the applicator.

133. The method of claim 132, further comprising removing the applicator from the second compartment.

134. The method of claim 132, wherein the applicator is attached to the second compartment, and the method further comprises removing the closure element so as to expose the applicator.

135. The method of claim 132, wherein reducing the volume of the first compartment comprises moving at least a portion of the first compartment toward the second compartment.

136. The method of claim 135, wherein moving at least a portion of the first compartment toward the second compartment comprises moving the at least a portion of the first compartment in a non-rotating manner relative to the second compartment.

137. The method of claim 135, wherein moving at least a portion of the first compartment toward the second compartment comprises rotating the first compartment and the second compartment relative to each other.

138. The method of claim 137, wherein the device further comprises an actuator interconnecting the first compartment to the second compartment, and wherein the rotating the first compartment and the second compartment relative to each other comprises rotating one of the first compartment and the second compartment relative to the actuator.

139. A device for applying a product, the device defining a height and comprising:

a first compartment defining a reservoir for containing a product, wherein the first compartment has a variable volume;

a second compartment defining an opening and being in one of selective and permanent flow communication with the first compartment via at least one orifice, the second compartment being configured to at least partially receive an applicator, and defining a volume which is substantially fixed; and a closure element configured to close off the opening of the second compartment, wherein the device is configured so that the height of the device diminishes as the volume of the first compartment becomes reduced, wherein the device lacks a bellows and lacks a biased piston, wherein an interior of the second compartment is sealed in substantially product-tight manner with respect to the exterior of the device when the closure element closes the opening of the second compartment, and wherein the first compartment defines a cross-section that remains substantially constant when the volume of the first compartment is reduced.

140. The device of claim 139, wherein the closure element is configured to seal the opening of the second compartment in a substantially product-tight manner.

141. The device of claim 139, wherein the device further comprises a piston configured to slide axially in the first compartment in response to a force exerted on the second compartment.

142. The device of claim 141, wherein the piston is configured to slide inside the first compartment in response to a force exerted on the closure element.

143. The device of claim 139, further comprising a one-way valve configured to close the orifice, wherein the one-way valve is configured to open to permit product flow toward the second compartment in response to an overpressure generated in the first compartment.

144. The device of claim 139, further comprising an applicator configured to be received at least partially in the second compartment.

145. The device of claim 144, wherein the applicator is fixedly attached to the closure element.

146. The device of claim 145, wherein the applicator is fixedly attached to the closure element via at least one of adhesive bonding, welding, and pinching.

147. The device of claim 144, wherein the closure element is configured to provide a gripping surface for the applicator.

148. The device of claim 144, wherein the second compartment comprises a wall and the applicator is fixedly attached to the wall of the second compartment.

149. The device of claim 144, wherein the applicator is at least one of configured to be loaded with cosmetic product at its surface and configured to be loaded with cosmetic product through its depth.

150. The device of claim 144, wherein at least a portion of a surface of the applicator is covered with a flocking.

151. The device of claim 144, wherein the second compartment defines an inner wall, and the applicator contacts at least a portion of the inner wall of the second compartment.

152. The device of claim 151, wherein the inner wall defines a base of the second compartment and the applicator contacts the base of the second compartment.

153. The device of claim 144, further comprising a product contained in the first compartment.

154. The device of claim 153, wherein the product comprises a cosmetic product.

155. The device of claim 154, wherein the cosmetic product comprises at least one of a liquid, a milk, a cream, and a gel.

156. A method of applying a product, the method comprising:

providing the device of claim 154;

reducing the volume of the first compartment so as transfer at least a portion of the product from the first compartment to the second compartment; and applying at least a portion of the product to a body portion using the applicator.

157. The method of claim 156, further comprising removing the applicator from the second compartment.

158. The method of claim 156, wherein the applicator is attached to the second compartment, and the method further comprises removing the closure element so as to expose the applicator.

159. The method of claim 156, wherein reducing the volume of the first compartment comprises moving at least a portion of the first compartment toward the second compartment.

160. The method of claim 159, wherein moving at least a portion of the first compartment toward the second compartment comprises moving the at least a portion of the first compartment in a non-rotating manner relative to the second compartment.

161. The method of claim 159, wherein moving at least a portion of the first compartment toward the second compartment comprises rotating the first compartment and the second compartment relative to each other.

162. The method of claim 161, wherein the device further comprises an actuator interconnecting the first compartment to the second compartment, and wherein the rotating the first compartment and the second compartment relative to each other comprises rotating one of the first compartment and the second compartment relative to the actuator.

163. The device of claim 1, further comprising a cosmetic product contained in the first compartment.

* * * * *

UNITED STATES PATENT AND TRADEMARK OFFICE

CERTIFICATE OF CORRECTION

PATENT NO. : 6,776,549 B2
DATED : August 17, 2004
INVENTOR(S) : Jean-Louis H. Gueret It is certified that error appears in the above-identified patent and that said Letters Patent is hereby corrected as shown below:

Column 12,
Line 20, "closing" should read -- closes --.

Column 20,
Line 39, "in substantially" should read -- in a substantially --.

Signed and Sealed this

Thirtieth Day of November, 2004

JON W. DUDAS
*Director of the United States Patent and Trademark Office*